US006778636B1

(12) United States Patent
Andrews

(10) Patent No.: US 6,778,636 B1
(45) Date of Patent: Aug. 17, 2004

(54) ADJUSTABLE X-RAY BEAM COLLIMATOR FOR AN X-RAY TUBE

(75) Inventor: Gregory C. Andrews, Sandy, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 10/165,262

(22) Filed: Jun. 6, 2002

(51) Int. Cl.[7] ..... G21K 1/04
(52) U.S. Cl. ..... 378/150; 378/147
(58) Field of Search ..... 378/147–151

(56) References Cited

U.S. PATENT DOCUMENTS 4,380,820 A * 4/1983 Cutter ..... 378/153
4,672,648 A * 6/1987 Mattson et al. ..... 378/4
4,897,861 A * 1/1990 Schaefer et al. ..... 378/150
4,905,268 A 2/1990 Mattson et al. ..... 378/158
5,287,396 A * 2/1994 Stegehuis ..... 378/98.2
5,689,544 A * 11/1997 Van Den Besselaar ..... 378/150
5,991,362 A * 11/1999 Jones ..... 378/152
6,320,936 B1 * 11/2001 Holland, Sr. et al. ..... 378/140

* cited by examiner

*Primary Examiner*—Craig E. Church
*Assistant Examiner*—Jurie Yun
(74) *Attorney, Agent, or Firm*—Workman Nydegger

(57) ABSTRACT

An adjustable collimator for reducing the emission of off-focus radiation and for use in selectively altering the size of an x-ray beam produced by an x-ray tube is disclosed. The collimator comprises a base member supporting a collimator plate that defines a first x-ray passing region. A radiation blocking member is operably attached to a moveable block that is disposed in the base member such that selective movement of the block causes the blocking member to obstruct and thereby reduce the size of the first region and create a smaller-dimensioned second region through which x-rays can pass.

36 Claims, 6 Drawing Sheets

ADJUSTABLE X-RAY BEAM COLLIMATOR FOR AN X-RAY TUBE

BACKGROUND OF THE INVENTION

1. The Field of the Invention

The present invention generally relates to x-ray tube devices. In particular, the present invention relates to an adjustable collimator that can be used to selectively control the size and shape of an x-ray signal pattern that is emitted from an x-ray tube, and at the same time minimize the amount of off-focal radiation that is emitted.

2. The Related Technology

X-ray producing devices are extremely valuable tools that are used in a wide variety of applications, both industrial and medical. For example, such equipment is commonly employed in areas such as medical diagnostic examination and therapeutic radiology, semiconductor manufacture and fabrication, and materials analysis.

Regardless of the applications in which they are employed, x-ray devices operate in similar fashion. In general, x-rays are produced when electrons are emitted, accelerated, and then impinged upon a material of a particular composition. This process typically takes place within an evacuated enclosure of an x-ray tube. Disposed within the evacuated enclosure is a cathode, or electron source, and an anode oriented to receive electrons emitted by the cathode. The anode can be stationary within the tube, or can be in the form of a rotating annular disk that is mounted to a rotor shaft which, in turn, is rotatably supported by a bearing assembly. The evacuated enclosure is typically contained within an outer housing, which also serves as a coolant reservoir.

In operation, an electric current is supplied to a filament portion of the cathode, which causes a cloud of electrons to be emitted via a process known as thermionic emission. A high voltage potential is placed between the cathode and anode to cause the cloud of electrons to form a stream and accelerate toward a focal spot disposed on a target surface of the anode. Upon striking the target surface, some of the kinetic energy of the electrons is released in the form of electromagnetic radiation of very high frequency, i.e., x-rays. The specific frequency of the x-rays produced depends in large part on the type of material used to form the anode target surface. Target surface materials with high atomic numbers ("Z numbers") are typically employed. The target surface of the anode is oriented so that the x-rays are emitted through windows defined in the evacuated enclosure and the outer housing. The emitted x-ray signal is then directed towards an x-ray subject, such as a medical patient, so as to produce an x-ray image.

Unfortunately, a portion of the x-rays produced within an x-ray tube do not originate at the focal spot of the anode. In fact, a significant portion of the x-rays are emitted from regions of the anode other than the focal spot; these x-rays are commonly referred to as "off-focal" radiation. This off-focal radiation can substantially degrade the image quality that is generated from the x-ray signal that is emitted from the x-ray tube, such as in a computed tomography device (CT scanner). Thus, there is a need to equip the x-ray tube generating device with a device that minimizes the amount of off-focal radiation that is emitted.

One device used to minimize off-focal radiation is an x-ray collimator. A typical x-ray beam collimator assembly comprises a mass of x-ray attenuating material, such as lead, with an opening defined therein. The collimator is then aligned with the window of the x-ray tube so that on-focus radiation (i e., x-rays that originate at the focal spot) can pass through the opening, and off-focal radiation is blocked by the x-ray attenuating portion of the collimator. Due to the manner in which x-rays are emitted from the anode, the collimator must be positioned as close as possible to the anode to block all off-focal radiation. However, existing collimator designs are positioned too far from the anode and the typically allow some off-focal radiation to escape.

In addition to minimizing the amount of off-focal radiation that is emitted, there is often a need to control the size and dimension of the pattern of the x-ray signal that exits the x-ray tube. The ideal dimensions of an x-ray signal are often dependent on the particular application involved. For example, in certain types of diagnostic radiology, x-ray signal having a relatively large pattern is used to produce images of relatively large portions of a patient's body. At other times, a smaller and more focused x-ray beam signal is used to produce detailed images of relatively small portions of the patient's body, such as regions of the head, for instance.

Thus, there is a need in the art for an x-ray tube collimation assembly that minimizes the amount of off-focal radiation that is emitted, so as to insure an accurate x-ray image. Moreover, it would be desirable if the collimation assembly was adjustable in a manner that permits selective control over the size, shape and dimensions of the x-ray signal pattern that is emitted.

BRIEF SUMMARY OF THE INVENTION

The present invention has been developed in response to the above and other needs in the art. Briefly summarized, embodiments of the present invention are directed to a collimator assembly that minimizes the amount of off-focal radiation that is emitted from the x-ray generating device. Moreover, of the collimator assembly is capable of selectively altering the dimensions of an x-ray signal pattern that is emitted.

In one preferred configuration, the collimator assembly includes a primary x-ray passage area that is configured to allow an x-ray signal to pass and that is collimated to have a first predetermined shape and dimension. In a preferred embodiment, this primary x-ray passage area is shaped so as to provide an x-ray signal having pattern that is relatively broad, such as could be used to create a diagnostic x-ray image of relatively large portions of a patient's body, such as whole body CT scans. In addition, in a preferred embodiment the collimator assembly is also capable of selectively defining a secondary x-ray passage area. This secondary passage area is configured to allow an x-ray signal to pass having a pattern with a different shape and dimension. In a preferred embodiment, the secondary x-ray passage area is configured to emit a smaller, more focused x-ray beam. This smaller beam is useful in creating more detailed images of small portions of a patient's body, such as a head scan in a CT scanner. Importantly, in either configuration, the collimator assembly is configured in a manner so as to minimize the emission of any off-focal radiation from the x-ray generating device, thereby insuring a high quality x-ray image.

In one presently preferred embodiment, the adjustable x-ray beam collimator assembly comprises a collimator plate having a slot that defines the primary x-ray passage area. In one embodiment, the slot has a rectangular shape, but other geometric shapes could also be utilized, depending on the needs of any particular application. The collimator plate is preferably at least partially comprised of an x-ray attenuating material that is capable of blocking off-focal radiation. In a preferred embodiment, the collimator plate is mounted at an end of a base member. This base member is mounted to the outer housing of the x-ray tube in a manner so that the plate is positioned immediately adjacent to the rotating anode. This ensures that a majority of the off-focal radiation is blocked. Of course, the collimator assembly could be mounted differently—including at points external to the outer housing of the x-ray tube—depending on the needs of the particular application.

The collimator assembly further includes a blocking member that can be selectively positioned with respect to the first x-ray passage area so as to form the secondary x-ray passage area. The size (and shape) of the opening defined by this second x-ray passage area depends on the shape and size of the blocking member and its position relative to the primary x-ray passage area.

In one embodiment, movement of the blocking member is accomplished via a retracting arm that rotates a lever about a pivot point, thus causing the blocking member to move to an extended position. In this extended position, at least a portion of the blocking member physically obstructs a portion of the first x-ray passing region, thereby defining the second x-ray passing region. At least a portion of the blocking member is formed of a radiation attenuating material, thereby effectively reducing the pattern size of the x-ray signal that passes through the first x-ray passing region defined in the collimator plate. Thus, the second x-ray passing region has dimensions that are smaller than those of the first x-ray passing region.

These and other features and advantages of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Reference will now be made to the Figures to further describe and illustrate embodiments of the invention. It is understood that the drawings are diagrammatic and schematic representations of presently preferred embodiments of the invention, and are not limiting of the present invention nor are they necessarily drawn to scale.

FIGS. 1–4 depict various features of embodiments of the present invention, which is generally directed to an adjustable collimator assembly that minimizes the amount of off-focal radiation that is emitted from an x-ray generating device. At the same time, the assembly allows for selective adjustment of the dimensions of the x-ray beam signal that is emitted from the x-ray generating device. For example, for a full body scan with a CT scanner device, an x-ray beam having larger dimensions can be selected. For a smaller sized scan, such as a head scan, an x-ray beam having smaller dimensions can be selected. In either case, the emission of off-focal radiation is minimized by the collimator, thereby insuring a higher quality x-ray image.

Figure 1:
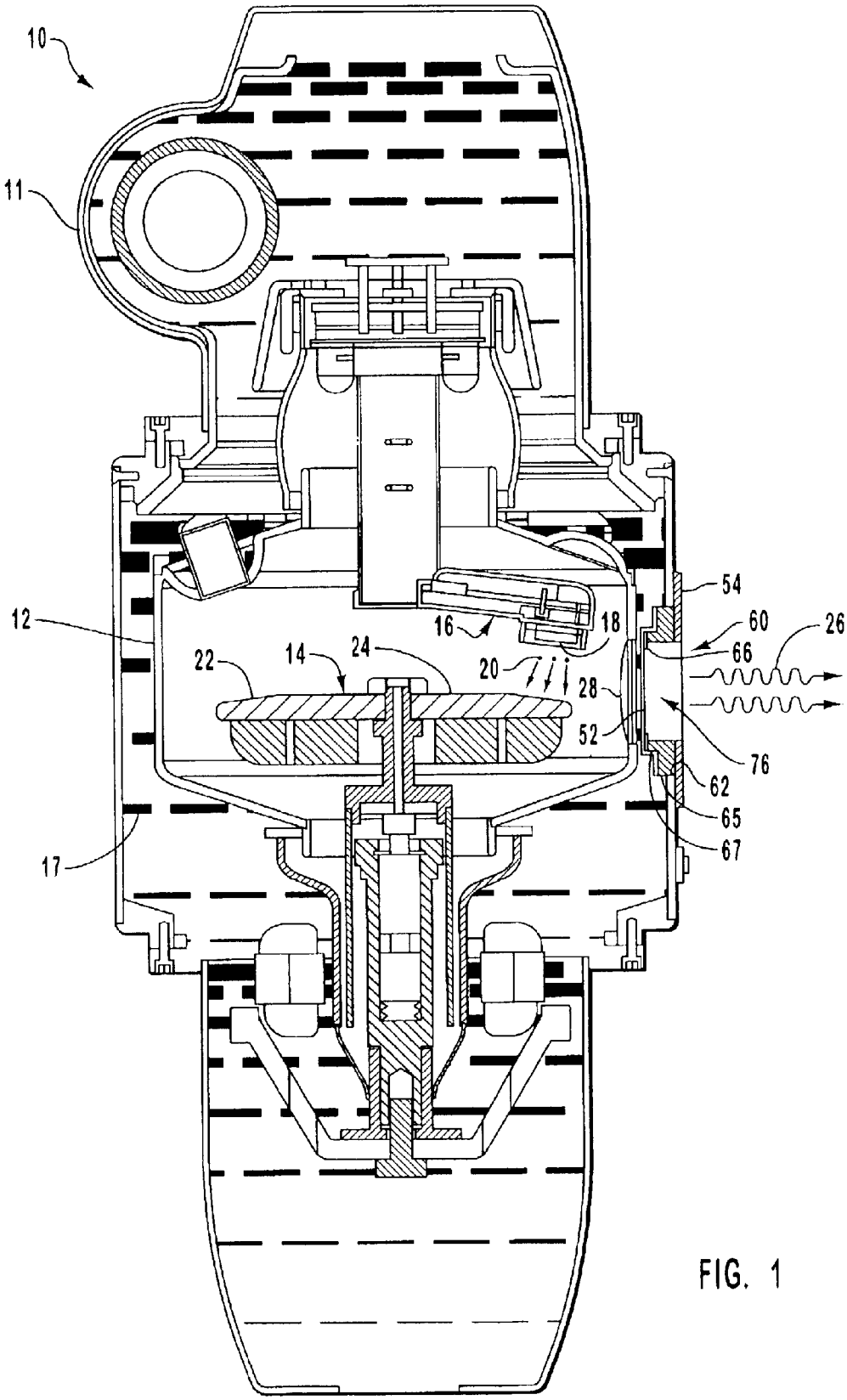
FIG. 1 is a cross-sectional view of a rotating anode x-ray tube, including an adjustable x-ray beam collimator assembly manufactured in accordance with one presently preferred embodiment of the claimed invention.

Reference is first made to FIG. 1, which illustrates a simplified structure of a conventional rotating anode-type x-ray tube, designated generally at 10. X-ray tube 10 includes an outer housing 11, within which is disposed an evacuated enclosure 12. A coolant 17 circulates within the outer housing 11 and around the evacuated enclosure 12 to assist in tube cooling. Disposed within the evacuated enclosure 12 is a rotating anode 14 and a cathode 16. The anode 14 is spaced apart from and oppositely disposed to cathode 16, and is at least partially composed of a thermally conductive material such as Tungsten or a molybdenum alloy. The anode 14 and cathode 16 are connected within an electrical circuit that allows for the application of a high voltage potential between the anode and the cathode. The cathode 16 includes a filament 18 that is connected to an appropriate power source, and during operation, an electrical current is passed through the filament 18 to cause electrons, designated at 20, to be emitted from the cathode 16 by thermionic emission. The application of a high voltage differential between the anode 14 and the cathode 16 then causes the electrons 20 to accelerate from the cathode filament 18 toward a focal track 22 that is positioned on a target surface 24 of rotating anode 14. The focal track 22 is typically composed of tungsten or a similar material having a high atomic ("high Z") number. As the electrons 20 accelerate, they gain a substantial amount of kinetic energy, and upon striking the target material on the focal track 22, some of this kinetic energy is converted into electromagnetic waves of very high frequency, i.e., x-rays.

The focal track 22 and the target surface 24 are oriented so that emitted x-rays are directed towards a window 28. The window 28 is comprised of an x-ray transmissive material that is positioned within a port defined through a wall of the evacuated enclosure 12 at a point adjacent to the focal track 22.

Positioned adjacent to the window 28 is one embodiment of an adjustable collimator assembly, which is designated generally at 60. As is generally shown in FIG. 1, in a presently preferred embodiment the collimator assembly 60 is mounted to the x-ray tube outer housing 11 via a mounting plate 54 in a manner so that a portion of the collimator assembly extends within the interior of the outer housing 11 through port 62. Also, the attachment forms a fluid tight seal with port 62. This orientation ensures that the collimator 60 is positioned as closely as possible to the anode 14 so that a maximum amount of off-focal radiation is blocked. In this way, the x-rays that are permitted to exit via the collimator—denoted at 26—are composed primarily of x-rays resulting from electrons striking the focal spot on the anode.

As already discussed, the collimator assembly 60, when disposed in operable relationship with the x-ray tube 10, minimizes the emission of off-focal radiation. Also, the assembly can be used to selectively alter the shape of the x-ray signal 26 that is emitted by the x-ray tube 10. This in turn enables the beam of x-rays 26 to be used in various applications requiring varying beam shapes. In general, this is accomplished by selectively altering the shape of an aperture through which the x-rays 26 can pass.

In one presently preferred embodiment, the collimator assembly 60 includes a base member portion 64 that supports a collimator plate 66. As is shown in FIG. 1 and FIG. 2B, in one embodiment the collimator plate 66 is connected directly to the distal end surface 64A of the base member 64. The collimator plate 66 can be formed integrally with the base member 64 or, as shown in FIG. 2B, can be affixed thereto via mechanical fasteners (such as is shown at 53A and 53B) or the like. The collimator plate 66 includes a primary, or first x-ray passing region, through which an x-ray signal may pass, as is denoted at 26. In the illustrated embodiment, this x-ray passing region is formed as a rectangular slot 80, although any other desired shape could be used. The body of the collimator plate 66 is composed of an x-ray attenuating material such that x-ray signals incident upon the collimator plate cannot penetrate through it except via the slot 80. In one presently preferred embodiment, the collimator plate 66 comprises lead, though other x-ray attenuating materials, such as tungsten, bismuth, etc., may alternatively be used.

In a preferred embodiment, the base member 64 is preferably implemented in a manner so as to provide maximum off-focal radiation blocking characteristics. In particular, the base member 64 is arranged so as to dispose the collimator plate 66 as closely as possible to the focal point of the anode 14, which insures that x-rays that are emitted from areas other than the focal spot (i.e., off-focal radiation) do not pass through the x-ray passage area but are instead blocked by the attenuation portion of the collimator plate. In particular, in one illustrated embodiment, the base member 64 comprises a main body portion having an outer periphery (denoted at 65 in FIG. 2B) that conforms to the shape of a port 62 formed in the outer housing 11 of x-ray tube 10. In the example shown, the outer periphery is circular, but other shapes could be used. In a preferred embodiment, the base member 64 includes a second, stepped down portion defining a distal face 64A (FIG. 2B) that has a reduced diameter periphery 67 that is projected inwardly from the outer housing 11 when the collimator assembly 60 is mounted. As noted above, this portion of the base member supports the collimator disk 66, and the inward orientation insures that the collimator disk 66 is oriented close to the focal spot on the anode disk 14, as is generally depicted in FIG. 1. Again, this insures that a majority of off-focal radiation is blocked during tube operation.

With continued reference to FIG. 1, the base member 64 includes a shaped cavity 76 defined therein. The shaped cavity 76 operably retains additional components of the present assembly 60 (discussed further below), and also includes an aperture portion that permits x-ray signals to pass once they have traveled through the x-ray passing region defined in the collimator plate 66. As noted, the mounting plate 54 can be integrally formed with the base member 64, as shown in FIG. 2B, or can be affixed via screws or any other suitable attachment method. The mounting plate 54 is then mounted to the outer housing 11 so as to orient the collimator plate 66 in the manner previously described. Also, the mounting plate 54 includes an x-ray passing region 114 (FIG. 4) to permit the collimated x-ray signal to pass. In the illustrated embodiment, a fluid tight sealing member is disposed over the collimator plate 66 and portions of the base member 64 so as to prevent fluid leakage through either the slot 80 or the rectangular slot 78. Here, the sealing member is provided via a window 52 attached to and covering the distal end of the collimator assembly. The window 52 is comprised of an x-ray transmissive material, such as aluminum or the like, enabling x-rays to pass through the slot 80 while preventing the escape of fluid through the slot.

The collimator plate 66 and the first x-ray passing region (such as slot 80) provide a primary x-ray collimation function. Thus, during tube operation, the x-rays that are produced at the target surface 24 of the anode 14 emanate in diverging straight lines from the focal spot of impact of the electrons 20. A significant number of these diverging x-rays pass through the window 28 and then interact with the collimator plate 66 of the collimator assembly 60. Because it is composed of an x-ray attenuating material, the collimator plate 66 attenuates and collimates substantially all x-rays 26 except those that are incident on the slot 80, which are substantially composed of primary x-rays. The collimated x-rays, designated at 26, are then allowed to pass freely through the path defined by the rectangular slot 78 formed through the base member 64, and the x-ray passing region 114 formed in the mounting plate 54. Thus, it is seen that the collimator plate 66 defines a primary radiation passing region 82 (see FIG. 3A) through which only those x-rays 26 having a sufficiently proper trajectory and that are incident upon the slot 80 are able to pass. The primary radiation passing region 82 defined by the slot 80 and the rest of the collimator assembly enables a broad, fan-shaped beam of x-rays 26 to be emitted by the x-ray 10.

In a presently preferred embodiment the collimator assembly also includes means for selectively defining at least one new x-ray passage area that has dimensions different from that of the first x-ray passing region, thereby altering the shape and/or size of the x-ray signal 26. By way of example and not limitation, in one preferred embodiment the definition means is implemented via a moveable blocking member, such as is generally designated at 70 in FIG. 2B, that can be selectively positioned with respect to the primary radiation passing region (denoted at 82 in FIG. 3A) so as to define a secondary x-ray passing region (denoted at 90 in FIG. 3B). Thus, for example, the collimator assembly 60 can be manipulated in a manner so that the x-ray signal 26 is collimated via the secondary x-ray passing region 90, which reduces the size of the x-ray signal pattern. This may be useful, for example, where a smaller signal is required such as when performing a head scan with a CT scanner device.

Reference is next made to FIGS. 2 and 3 together, which illustrate in further detail one preferred embodiment of the x-ray definition means. As is shown, a T-shaped block 68, best shown in FIG. 2B, is disposed in the collimator assembly 60 so as to be selectively moveable. In a retracted position the block 68 seats within a correspondingly shaped portion of the cavity 76 of the base member 64. The block 68 is configured to selectively move from this retracted position to an extended position within the cavity 76 of the base member 64. Movement from the retracted to the extended position occurs in a substantially linear fashion. At least one guide rod is disposed in the cavity 76 of the base member 64 to guide the block 68 from the retracted to the extended position. In the illustrated embodiment, two parallel guide rods 84, comprising smooth pins are each mounted in the base member 64 and extend into the cavity 76 to engage holes defined in the block 68. To assist in reducing sliding friction between the block 68 and the guide rods 84, a lubricating material can be provided. In the illustrated embodiment, cylindrical bearings 86 are interposed between each guide rod 84 and the hole defined in the block 68 to enable low-friction movement of the block.

The moveable blocking member 70 is provided to enable selective collimation of the x-ray beam 26 as it passes through the collimator assembly 60 during tube operation. The moveable blocking member 70 is operably attached to the block 68, and is disposed adjacent to the stationary collimator plate 66. Movement of the block 68 into an extended position moves the blocking member 70 into the region of the rectangular slot 78 of the base member 64. As best seen in FIG. 2B, the moveable blocking member 70 in one presently preferred embodiment is mounted, via two screws, on a surface of the block 68 that is nearest and adjacent to the stationary collimator plate 66. In this particular embodiment, the blocking member 70 is shaped so as to define two extensions 88 and 89 that extend into the primary radiation passing region 82 (see FIG. 3A) adjacent the slot 80 when the block 68 is moved from the retracted to the extended position. This reduces the pathway through which the x-ray beam 26 may pass, thereby defining a secondary radiation passing region 90 (see FIG. 3B) having dimensions that are smaller than the primary radiation passing region 82. In order to define the smaller secondary radiation passing region 90, the blocking member 70, including the blocking member extensions 88 and 89, is composed of an x-ray attenuating material, preferably similar to that of the collimator plate 66. Such x-ray attenuating materials may include lead, tungsten, bismuth, etc., or alloys of such materials.

The collimator assembly 60 also includes means for selectively moving the block 68. In presently preferred embodiments, the means for selectively moving the block 68 comprises a lever 72, which, like block 68, is disposed in the cavity 76 of the base member 64. The lever 72 is disposed within the cavity 76 such that it is adjacent the block 68. In the illustrated embodiment, the lever 72 comprises an "L"-shaped member having a first leg 72A and a second leg 72B disposed at a right angle to one another. Disposed at the intersection of the two legs 72A and 72B is a pivot point about which the lever rotates. More specifically , a pivot hole 92 is defined in the lever 72 at the pivot point, and a pivot pin 94 passes through the pivot hole of the lever and into the base member 64 so as to rotatably attach the lever to the base member 64. A washer 96 may be interposed between the lever 72 and the base member 64 to further enable rotation of the lever about the pivot point.

Figure 2A:
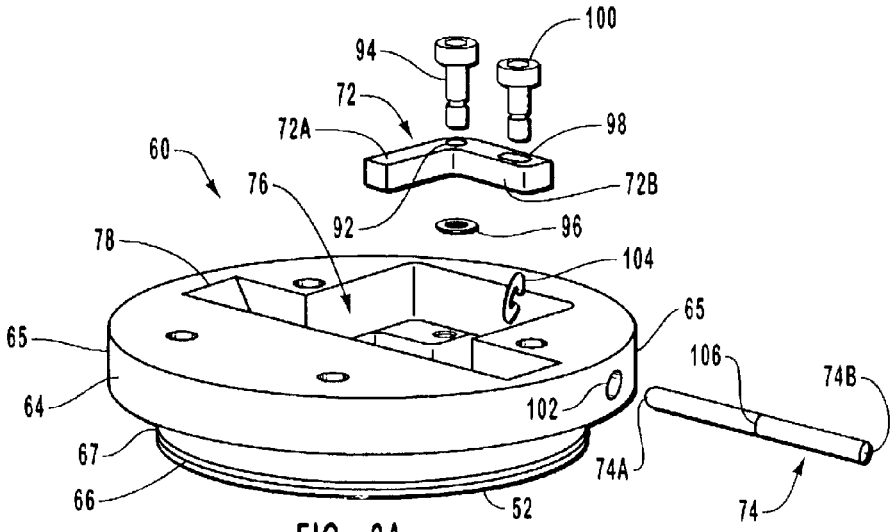
FIG. 2A is an exploded top view of an adjustable x-ray beam collimator assembly according to one presently preferred embodiment.
Figure 2B:
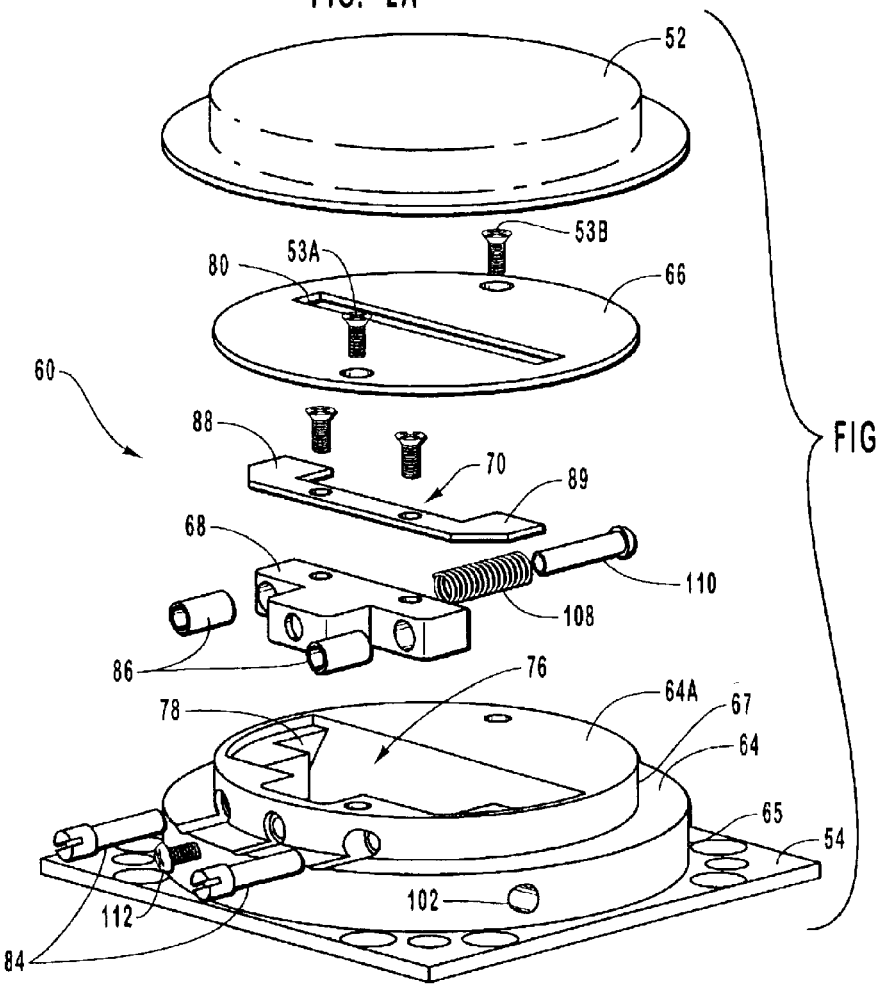
FIG. 2B is an exploded bottom view of the adjustable collimator assembly of FIG. 2A.

As seen in FIG. 2A (shown with the mounting plate 54 removed for clarity), the first leg 72A of the lever 72 is preferably solid, while the second leg 72B has defined there through an elongated slot 98 defined near the end of the leg. A slide pin 100 passes through the elongated slot 98 and into the block 68, operably attaching the lever 72 to the block. This arrangement enables the selective movement of the lever to affect the position of the block 68 within the cavity 76 of the base member 64.

In the illustrated embodiment, the assembly further includes a retractable arm 74, which enables selective movement of the lever 72. As seen in FIG. 2A, the retractable arm 74 comprises a rigid, elongated rod that is partially disposed in a hole 102 defined in the base member 64. The arm hole 102 passes from the outer periphery of the base member 64 to the cavity 76, thereby enabling a first end 74A of the arm 74 to reside in the cavity. The retractable arm 74 is also axially slidable within the arm hole 102 between a non-engaged position, and an engaged position wherein the arm is in operable contact with the lever 72. In the non-engaged position, the first end 74A of the retractable arm 74 does not engage the lever 72. However, in the engaged position, the first end 74A engages the first leg 72A of the lever 72 such that the lever 72 is selectively rotated by the retractable arm 74. A second end 74B of the retractable arm 74 is disposed near the outlet of the arm hole 102 in the outer periphery of the base member 64. The retractable arm 74 can be retained within the arm hole 102 via a C-clip 104 that seats in an annular notch 106 defined on the outer surface of the arm. When the C-clip 104 is disposed in the annular notch 106, the retractable arm is prevented from further outward movement axially from the arm hole 102 once the C-clip contacts the inner wall of the cavity 76 in the base member 64. Selective movement of the retractable arm 74 from its non-engaged position to its engaged position may be accomplished via an actuator (not shown) that can be operably connected to the second end 74B of the arm. The actuator enables remote manipulation of the retractable arm 74, which in turn moves the lever 72, thereby actuating the block 68 and the locking member 70, as described further below. Though the lever 72 and the retractable arm 74 together comprise one means for selectively moving the block 68 from a retracted position to an extended position, it is appreciated that other configurations may be used to selectively move the block. For example, while the arm 74 has been illustrated as a rigid rod in this particular embodiment and movement is imposed via a pushing force, in an alternative embodiment it could be implemented as a flexible cable, and movement imposed via a pulling force.

In a preferred embodiment, the block 68 is biased to its respective retracted position by a resilient member, such as a compression spring 108. The spring 108 urges the block 68 into its retracted position within the cavity 76 of the base member 64 when the block is in the extended position. When allowed to move to the retracted position by the lever 72 and arm 74, the block 68 is maintained in that position by the spring 108 until it is again moved by the lever and the arm. The bias force provided by the spring 108 to retain the block 68 in its retracted position also serves to urge the lever 72 and the retractable arm 74, which are interconnected with the block, into their seated and non-engaged positions, respectively, until they are acted upon by an actuator (not shown) or other device. As seen in FIG. 2B, the spring 108 is disposed within a hole bored into the block 68. The spring 108 is retained within the hole by a retention pin 110, which in turn is affixed to the base member 64 via a mechanical fastener, such as a screw 112. It is noted here that the spring 108 is but one example of a means for selectively retracting the block 68; other configurations for performing this functionality are also contemplated.

Several of the components discussed above, such as the base member 64, the lever 72, the retractable arm 74, the block 68, and the mounting plate 54 may be comprised of various materials, including various metals and metal alloys that can withstand the environmental conditions of the particular x-ray tube environment.

Figure 3A:
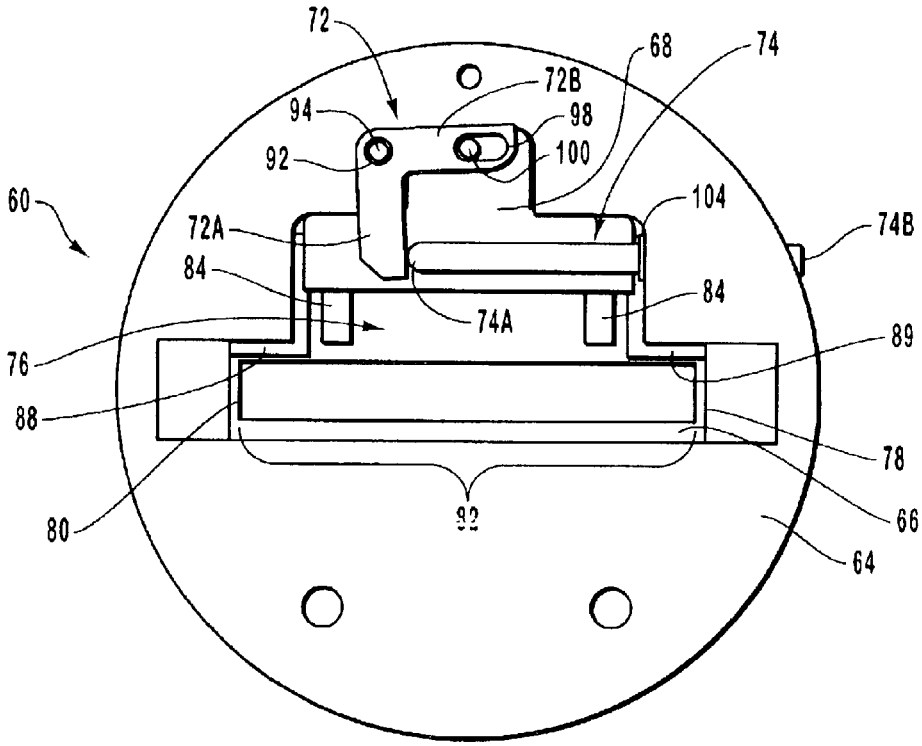
FIG. 3A is a top view of the adjustable collimator assembly of FIG. 2A as assembled, defining a primary radiation passing region.
Figure 3B:
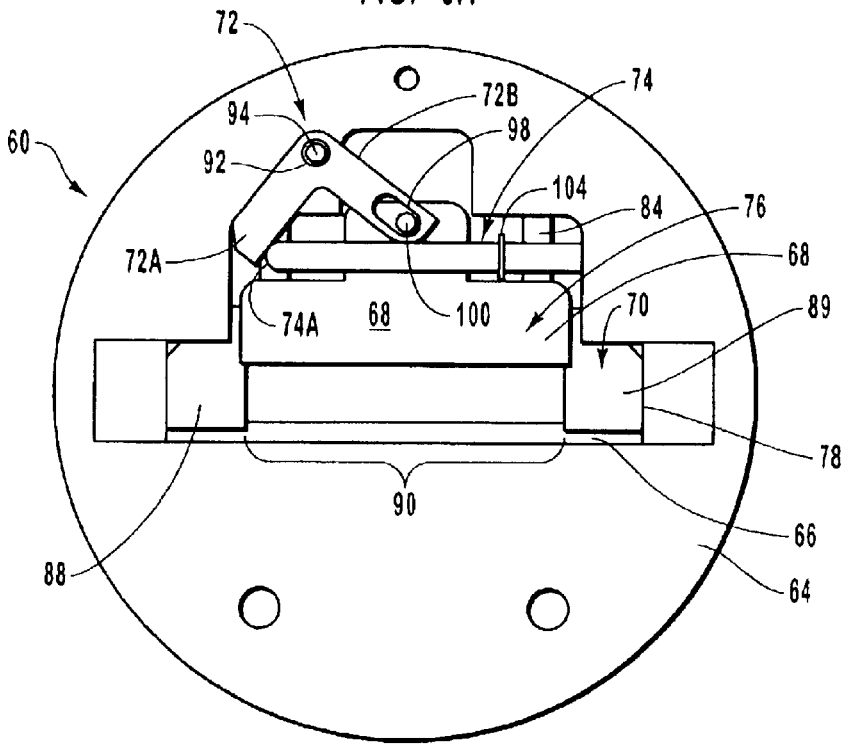
FIG. 3B is a top view of the adjustable collimator assembly of FIG. 2A as assembled, showing a secondary radiation passing region.

Reference is now made to FIGS. 3A and 3B which depict the collimator assembly 60 in varying stages of operation according to one presently preferred embodiment. As previously discussed, a portion of the x-rays 26 that are produced by interaction of the electrons 20 with the target surface 24 of the anode 14 are directed through the window 28 and then to the collimator assembly 60. This beam of x-rays 26 is initially collimated by interaction with the collimator plate 66 having the rectangular slot 80 defined therein. In addition to collimating primary x-rays that are produced at the focal spot on the anode 14, the collimator plate 66, due to its position and its material composition, also blocks a majority of off-focal radiation that is emitted through the window 28, i.e., radiation originating from electrons that do not strike the focal spot on the anode. Also, the amount of on-focus radiation that is emitted can also be further adjusted. In a first configuration of the collimator assembly 60 as shown in FIG. 3A, those x-rays 26 having the proper position and trajectory are allowed to pass through the slot 80, which defines the primary radiation passing region 82, shown in FIG. 3A. The rest of the x-rays 26 incident upon the collimator plate 66 are absorbed thereby and do not proceed through the collimator assembly 60. The beam of x-rays 26 that passes through the slot 80 defining the primary radiation passing region 82 continues through the slot 78 of the base member cavity 76 and the slot 114 in the plate 54 and then exits the collimator assembly 60. Thus, an unobstructed x-ray travel path from the collimator plate 66 through the cavity 76 of the base member 64 is established, as seen in FIG. 3A. In this first configuration, the arm 74 is in its non-engaged position, the lever 72 is seated, and the block 68, having the blocking member 70 attached thereto, is also in its retracted position. As already mentioned, the primary radiation passing region 82 defined by the collimator assembly 60 in this configuration allows an x-ray beam having a broad, fan-shaped pattern to be emitted by the x-ray tube 10. Such an x-ray beam may be desirable for producing radiographic images of a large portion of a patient's body, for instance.

In contrast to the relatively broad x-ray beam 26 produced by the collimator assembly 60 in the first configuration shown in FIG. 3A, a narrow, less divergent beam may be desired. This is achieved by altering the collimator assembly 60 to a second configuration, as shown in FIG. 3B. To do this, the retractable arm 74 is first pushed inward toward die interior of the cavity 76 of the base member 64. This may be accomplished by a remote actuator (not shown) applying a pushing force to the second end 74B of the arm 74. This causes the arm 74 to move axially inward toward the cavity 76, thereby moving from its non-engaged position and causing its first end 74A to engage the lever 72. As a result of the axial movement of the arm 74, the first end 74A of the arm engages the first leg 72A of the lever 72. As axial movement of the arm 74 continues, the lever 72 begins to rotate in a clockwise fashion about the pivot pin 94 disposed at the pivot point of the lever. This lever rotation can continue until the second leg 72B of the lever 72 contacts the retractable arm 74, as seen in FIG. 3B. The first end 74A of the arm 74 can be rounded to assist in the smooth engagement of the first end with the first leg 72A of the lever 72.

The selective movement of the lever 72 by the arm 74 in turn causes the movement of the block 68 from its retracted position to an extended position near the slot 78 of the base member 64. As already discussed, the block 68 is moveably connected to the lever 72 via the slide pin 100 that is fixably attached to the block and that passes through the elongated hole 98 defined in the second leg 72B of the lever. Thus, when the second leg 72B of the lever 72 is rotated in a clockwise direction, the slide pin 100 correspondingly causes movement of the block 68 from its retracted position and causes the block to slide along the guide rods 84 toward the slot 78 of the base member 64. Because the blocking member 70 is operably attached to the block 68, it too is moved toward the slot 78 of the base member 64. Once the lever 72 has fully rotated, thereby fully extending the block 68 as shown in FIG. 3B, the blocking member extensions 88 and 89 of the blocking member 70 are disposed in the rectangular slot 78 of the base member 64 adjacent the slot 80 of the collimator plate 66. These blocking member extensions 88 and 89 effectively reduce the area defined by the slot 80 through which the beam of x-rays 26 may pass in the collimator assembly 60. As seen in the figure, then, the secondary radiation passing region 90, having dimensions that are less than the primary radiation passing region 82 shown in FIG. 3A, is defined. The secondary radiation passing region 90 correspondingly produces a fan-shaped beam of x-rays 26 that is less divergent than that produced by the primary radiation passing region 82. This enables the x-ray tube 10 to be used in applications where such an x-ray beam is desirable, such as the production of radiographic images of small portions of a patient's body, for instance.

In the second configuration of the collimator assembly 60 discussed above, the position of the block 68 in its extended position, which in turn maintains the blocking member extensions 88, 89 in the slot 78 of the base member 64, is maintained by continual pressure on the retractable arm 74. When the secondary radiation passing region 90 that is defined by this configuration is no longer needed or desired, the pressure provided by the actuator or device may be released from the retractable arm 74. Release of this pressure allows the urging force provided by the spring 108 disposed within the block 68 to cause the block to retract into its retracted position. This causes the lever 72 to rotate counterclockwise to a seated position within the cavity 76 of the base member 64, which in turn causes the arm 74 to be pushed axially outward until the block 68 fully seats within the cavity of the base member. When the block 68 is fully seated, the blocking member 70, with its blocking member extensions 88, 89 is fully retracted from the rectangular slot 78 of the base member 64, thereby reestablishing the primary radiation passing region 82 in the collimator assembly 60. Thus, it is seen that either the first primary radiation passing region 82 or the secondary radiation passing region 90 can be selectively defined by the collimator assembly 60, according to the wishes of the user. In sum, then, the movement of the blocking member extensions 88, 89 into the slot 78 of the base member 64, thereby reducing the primary radiation passing region 82 defined by the slot 80 of the collimator plate 66 to the secondary radiation passing region 90, serves to selectively collimate and focus the beam of x-rays 26. This is done by attenuating x-rays that would otherwise pass through the first radiation passing region with the blocking member extensions 88, 89. Thus, the blocking member extensions 88, 89 in their extended position reduce the total number of x-rays that pass through the collimator assembly 60.

Figure 4:
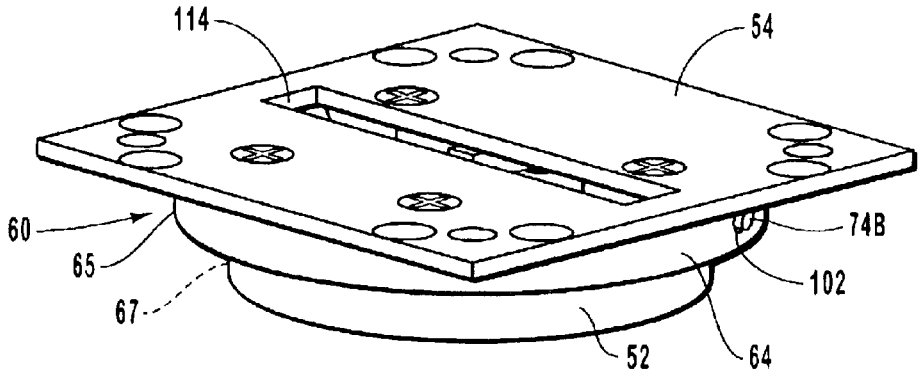
FIG. 4 is a perspective view of the assembled adjustable collimator attached to a mounting plate in accordance with one presently preferred embodiment of the present invention.

Reference is now made to FIG. 4 which shows the collimator assembly 60 fully assembled and attached to the mounting plate 54. Attachment of these two components may be accomplished by a variety of means, but in the illustrated embodiment it is accomplished via four screw threadably engaged between the two components. As already discussed the mounting plate 54 facilitates attachment of the collimator assembly 60 to the outer housing 11 of the x-ray tube 10, thereby incorporating the collimator assembly as part of the x-ray tube. However, it is appreciated that the collimator assembly may comprise a separate and distinct component from the x-ray tube 10 and may merely be disposed in the path of the x-ray beam 26 emitted by the x-ray tube 10.

In addition to the collimator assembly 60 as described in the accompanying figures, it is appreciated that the assembly can be configured to define more than two radiation passing regions. Indeed, the collimator assembly 60 could be configured to define three or more radiation passing regions by selectively moving blocking members having successively greater blocking extensions into the slot 78 of the base member 64 in a similar fashion to that described above. Moreover, the collimator assembly can be configured to selectively alter the width of the radiation passing region instead of, or in addition to, altering the length thereof. Finally, it is also appreciated that more than one collimator mechanism can be disposed in the base member. For example, first and second collimator assemblies can be disposed in the base member such that one or both assemblies can be actuated at any given time to selectively shape the x-ray beam in one of several possible collimating combinations. Thus, the above discussion of the collimator assembly 60 is not meant to be limiting of the present invention as it pertains to the number and/or specific configurations of the radiation passing regions created thereby.

Additional embodiments of the present invention are depicted in FIGS. 5A–6B. These embodiments share common features with the presently preferred embodiment already discussed; thus, only selected aspects of the following embodiments will be discussed below.

Figure 5A:
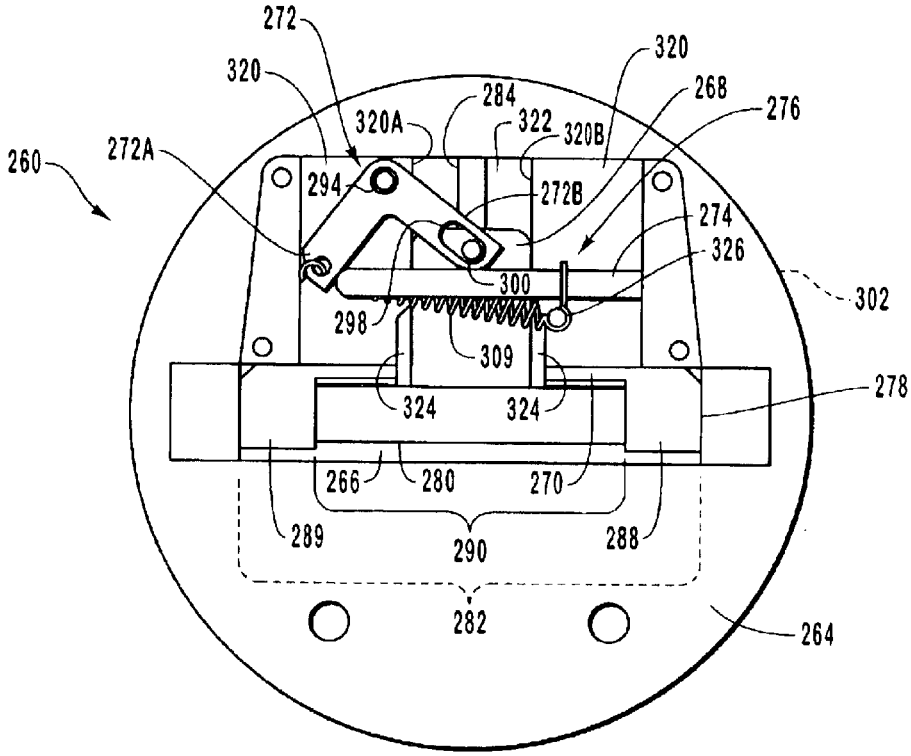
FIG. 5A is a top view of an adjustable collimator assembly manufactured in accordance with one alternative embodiment of the present invention.
Figure 5B:
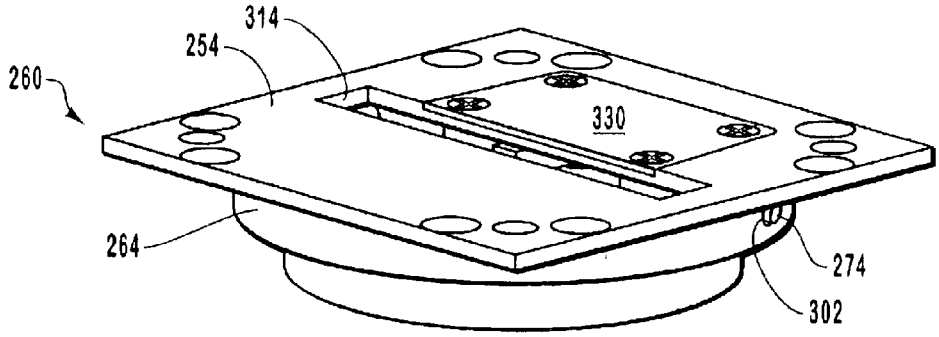
FIG. 5B is a perspective view of the collimator assembly of FIG. 5A, having a mounting plate attached thereto.

FIGS. 5A–5B depict features of one alternative embodiment of the present invention. A collimator assembly 260 is depicted, having a base member 264 in which is defined a shaped cavity 276 and a rectangular slot 278. The shaped cavity 276 defines two parallel-disposed plateaus 320 separated by a straight groove 322, which is in communication with the rectangular slot 278. The groove 322 is shaped to cooperatively receive a block 268. The block 268 includes tabs 324 disposed on opposite sides of the block. The tabs 324 are positioned such that they slidably engage inner edges 320A and 320B of the plateaus 320, enabling the block to linearly move in the groove 322 between retracted and extended positions. The tabs 324 also prevent rotation of the block 268 in the groove 322 during movement. Movement of the block 268 between retracted and extended positions is further assisted by a guide rod 284 affixed to the base member 264 and extending into the groove 322. The guide rod 284 is at least partially received by an axial hole defined in the block 268. Note that the shape, number, and positioning of the guide rod 284 and the tabs 324 on the block 268 can vary according to the physical configuration of the block and/or the cavity 276 in which the block is disposed.

A blocking member 270 having extensions 288 and 289 that comprise an x-ray attenuating material is attached to the block 268 such that it is disposed adjacent a collimator plate 266 disposed on an inner surface 264A of the base member 264.

A lever 272 having first and second legs 272A and 272B, respectively, is pivotally attached to one of the plateaus 320 via a pivot pin 294. An elongated slot 298 is defined in the second lever leg 272B to receive a slide pin 300 that is attached to the block 268. A retractable arm 274 is disposed through an arm hole 302 in the base member 264 to selectively engage the first lever leg 272A and enable the lever 272 to pivot about the pivot pin 294. When the arm 274 is disengaged from contact with the first lever leg 272A, a resilient member, such as a spring 309, can be employed to return the lever 272 to an un-pivoted position. In the illustrated embodiment, the spring 309 attaches at one end to the first lever leg 272A, and at the other end to a screw 326 (partially shown for clarity) attached to a portion of one of the plateaus 320. It is appreciated that the both the arm 274 and the spring 309 are merely representative of a variety of configurations that can be employed both to pivot the lever 272 and to provide an urging force thereto.

The above-described components cooperate to provide a means for selectively defining the shape of an x-ray passage area according to the present embodiment. With the block 268 in its retracted position (not shown), the blocking member 270 is withdrawn such that its blocking member extensions 288 and 289 do not block a primary radiation passing region, denoted in dashes at 282, which is defined by a slot 280 of the collimator plate 266. Similar to the presently preferred embodiment described further above, selective movement of the arm 274 against the first lever arm 272A causes the lever 272 to pivot in a clockwise direction. Because of the attachment of the second lever leg 272B with the block 268 via the slide pin 300, the pivoting of the lever 272 causes the block 268 to move from its retracted position. As the lever 272 continues to pivot, the tabs 324 of the block 268 slide along the plateau inner edges 320A and 320B, causing the block 268 to move linearly in the groove. This movement is also assisted by the guide rod 284. Movement of the block is continued until the lever 272 has fully pivoted, which places the block 268 in its extended position. In this position, the blocking member extensions 288 and 289 are disposed in the rectangular slot 278 such that they reduce the primary radiation passing region 282 to a smaller-sized secondary radiation passing region, denoted at 290.

When retraction of the block 268 is desired, the arm 274 can be retracted such that it disengages the first lever leg 272A. This enables the spring 309 to urge the lever 272 counterclockwise to its un-pivoted position, which also moves the block 268 to its retracted position. In this position, the blocking member extensions 288 and 289 are disposed away from the rectangular slot 278, thereby re-establishing the primary radiation passing region 282.

FIG. 5B depicts the collimator assembly 260 having a mounting plate 254 affixed thereto. The mounting plate 254 includes a slot 314 in communication with a larger gap (not shown). The gap is covered by cover plate 330, which is attached directly to the base member 264 via screws or the like. The gap and the removable cover plate enable access to the components of the collimator assembly 260 disposed in the base member cavity 276.

Figure 6A:
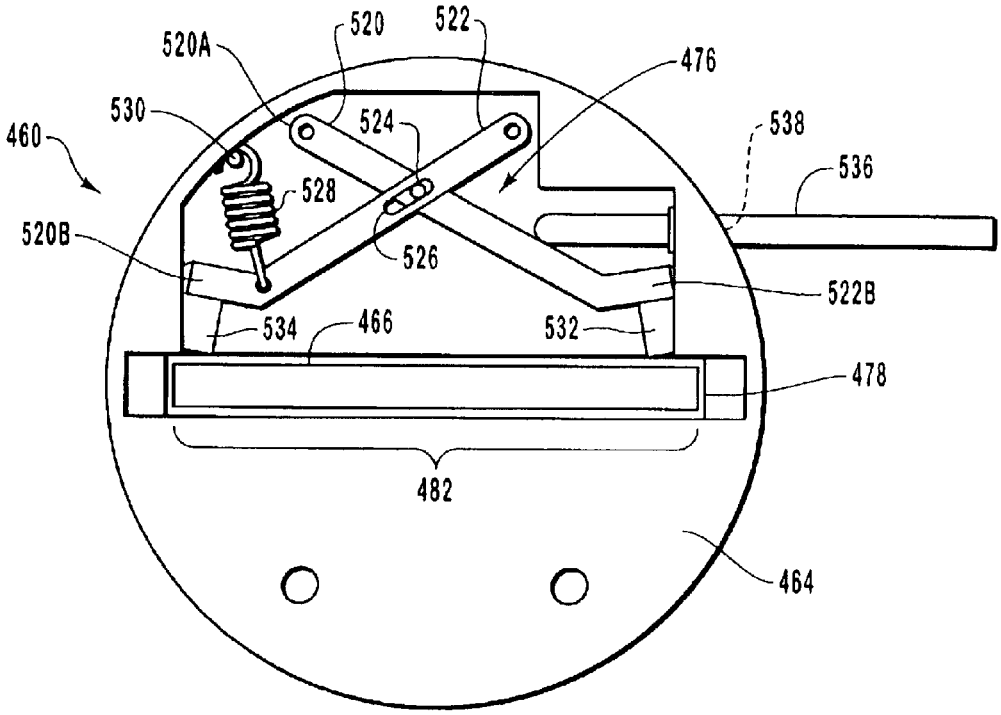
FIG. 6A is a top view of an adjustable collimator assembly manufactured in accordance with another alternative embodiment of the present invention, wherein the assembly defines a primary radiation passing region.
Figure 6B:
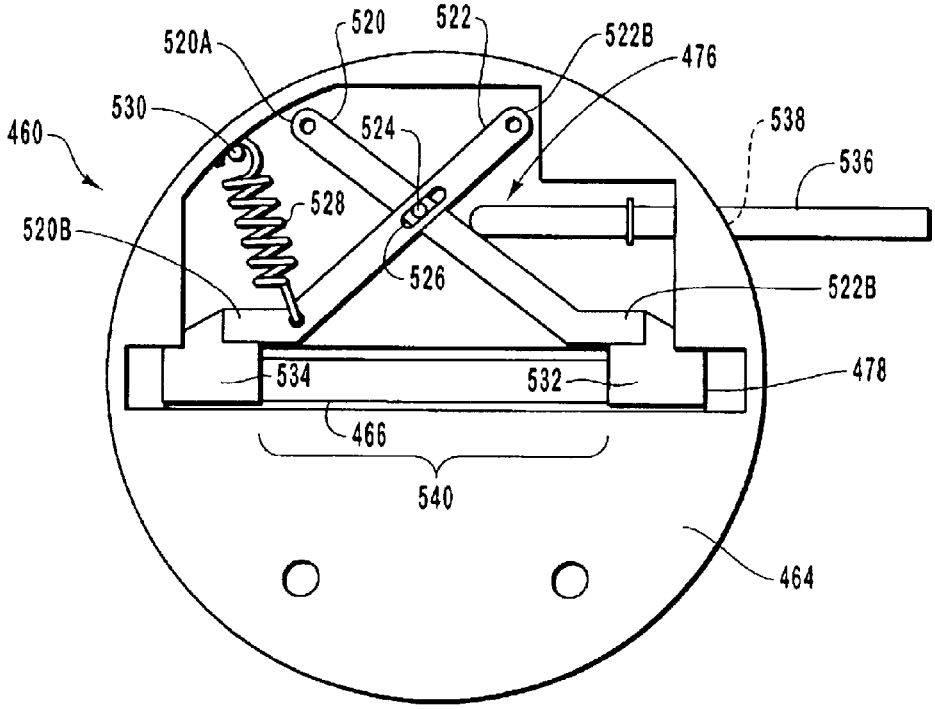
FIG. 6B is a top view of the adjustable collimator assembly of FIG. 6A, wherein the assembly defines a secondary radiation passing region.

Yet another embodiment of the present invention is depicted in FIGS. 6A and 6B, wherein another means for selectively defining x-ray passing regions is shown. Here, a collimator assembly 460, including a base member 464 having a cavity 476 and a rectangular slot 478, additionally comprises first and second interlinked scissor arms 520 and 522. The scissor arms 520 and 522 are pivotably secured to the base member 464 within the cavity 476 via bolts (not shown) at their respective first ends 520A and 522A. The first scissor arm 520 is interlinked with the second scissor arm 522 so as to enable coordinated movement of the two scissor arms. This is accomplished via a pin 524 fixedly disposed near the midpoint of the first scissor arm 520. The pin 524 extends from the first scissor arm 520 to engage an elongated slot 526 defined in the second scissor arm 522 near its midpoint. In this way, movement of one arm within the cavity 476 causes corresponding scissor movement of the other arm. This coordinated movement is employed in restricting a primary radiation passing region, denoted at 482, as more fully described below. As in previous embodiments, the primary radiation passing region can be defined by a collimator plate 466, though other configurations for defining the region are also contemplated. Also, while FIGS. 6A and 6B show one possible configuration for the scissor arms 520 and 522, other shapes and configurations are also contemplated.

The scissor arms 520 and 522 are biased toward a retracted position within the cavity 476 via a resilient member, such as a spring 528. In the illustrated embodiment, the spring 528 attaches at one end to a bolt, partially shown at 530, and at the other end to the second scissor arm 522 near the second end 522B thereof. The spring could be alternatively disposed in other configurations so as to provide an appropriate iasing force.

First and second scissor arms 520 and 522 further include radiation blocking members 532 and 534 attached to angled portions of the respective second ends 520B and 522*b* of the scissor arms. Each blocking member 532 and 534 is composed of an x-ray attentuating material and is attached to its respective scissor arm in such a way as to restrict x-ray passage through the primary radiation passing region 482.

A retractable arm 536 is provided to enable selective movement of the scissor arm 520 and 522. As before, the retractable arm 536 is disposed through an arm hole 538 defined in the base member 464 to enable the arm to axially move within the cavity.

The present collimator assembly 460 operates to define either the primary radiation passing region 482 or a smaller-sized secondary radiation passing region 540 according to the position of the scissor arms 520 and 522. In a retracted position, the spring 528 maintains the scissor arms 520 and 522 positioned such that the radiation blocking members 532 and 534 do not obstruct the rectangular slot 478. To move the scissor arms 520 and 522 from the retracted to the extended position, a pushing force is initiated by contact of the retractable arm 536 against the first scissor arm. The pushing force provided by the retractable arm 536 causes the first scissor arm 520 to pivot clockwise, bringing the radiation blocking member 532 into the rectangular slot 478. The second scissor arm 522, being interlinked with the first scissor arm 520 via the pin 524 and elongated slot 526, is pivoted in a counterclockwise fashion as a result of the movement of the first scissor arm, which in turn causes its radiation blocking member 534 to also move into the rectangular slot 478. The movement of the retractable arm 536 can be continued until the radiation blocking members 532 and 534 are fully extended into the rectangular slot 478, thereby restricting the primary radiation passing region 482 defined by the collimator plate 466 and defining the smaller secondary radiation passing region 540, as shown in FIG. 6B. Once it is desired to reestablish the primary radiation passing region 482, the retractable arm 536 is retracted from engagement with the first scissor arm 520. This allows the spring 528 to retract the scissor arms 520 and 522 into their retracted position, which removes the radiation blocking members 532 and 534 from the rectangular slot 478 and reestablishes the primary radiation passing region 482.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. An x-ray device, comprising:

a vacuum enclosure having disposed therein an electron-producing cathode and an anode positioned to receive the electrons produced by the cathode, the electrons impacting the anode such that a bean of x-rays is emitted through an x-ray transmissive window in a wall of the enclosure;

an outer housing defining an interior portion within which is disposed the vacuum enclosure, the outer housing defining a port; and an adjustable collimator comprising:

a base member at least partially disposed within the port of the outer housing;

a collimating plate mounted on an end of the base member and having a primary x-ray passage area that is substantially adjacent to the x-ray transmissive window so as to permit at least a portion of the emitted x-rays to pass, and wherein at least a portion of the collimating plate is composed of an x-ray attenuating material;

a fluid tight seal disposed between the primary x-ray passage area and the interior of the outer housing; and a block that is moveable in a substantially linear direction, the block having at least one blocking member that is at least partially composed of an x-ray attenuating material, the blocking member being movable in the linear direction between at least a retracted and a extended position, the blocking member partially blocking the aperture defined in the collimating plate when the blocking member is in the extended position such that a secondary x-ray passage area is defined through which the emitted x-rays can pass, the second passage area having smaller dimensions than the primary passage area.

2. An x-ray device as defined in claim 1, wherein the blocking member comprises at least two blocking portions, wherein each blocking portion blocks at least a portion of the primary x-ray passage area when the blocking member is in the extended position.

3. An x-ray device as defined in claim 1 further comprising a rigid arm that is selectively moveable between a first and a second position, the arm operably attached to the block via a lever, wherein movement of the arm from the first to the second position actuates the lever and causes the block to move the at least one blocking member from the retracted position to the extended position.

4. An x-ray device as defined in claim 3, wherein the lever comprises first and second legs disposed substantially at a right angle to one another, and wherein the arm actuates the lever by applying a force to the first leg.

5. An x-ray device as defined in claim 4, wherein the second leg of the lever includes an elongated hole, and wherein the block is connected to the lever by a pin that passes through the elongated hole and into the block.

6. An x-ray device as defined in claim 1, wherein the collimating plate and the at least one blocking member comprise a material selected from the group consisting of lead, tungsten, and bismuth.

7. An x-ray device as defined in claim 1, wherein the adjustable collimator further comprises a mounting plate that connects the adjustable collimator to the outer housing of the x-ray device.

8. An x-ray device as defined in claim 7, wherein the mounting plate is integrally formed with the base member.

9. An x-ray device as defined in claim 1, further comprising a second blocking member composed of an x-ray attenuating material, the second blocking member being movable in a linear direction independent of the at least one blocking member to partially block the aperture defined in the collimating plate.

10. An x-ray beam collimator assembly comprising:

a base member having an outer periphery that is adapted to be received within a port of an x-ray generating device;

a collimator plate attached to an end of the base member, the collimator plate being substantially comprised of an x-ray attenuating material and defining a primary x-ray passing region;

a blocking member that is attached to the base member in a manner such that the blocking member is selectively movable in a substantially linear direction between a retracted position and an extended position, wherein in the extended position at least a portion of the blocking member obstructs the primary x-ray passing region so as to define a second radiation passing region; and at least one guide rod, the guide rod being operable to effect movement of the blocking member between the retracted position and the extended position.

11. An x-ray beam collimator assembly as defined in claim 10, further comprising a retractable arm operably connected to the blocking member via a lever, the lever being connected to the blocking member such that movement of the retractable arm actuates the lever and moves the blocking member between the retracted position and the extended position.

12. An x-ray beam collimator assembly as defined in claim 11, wherein the retractable arm is at least partially disposed within a hole defined in the base member, and wherein the retractable arm is retained within the hole via a C-clip that is attached to the retractable arm.

13. An x-ray beam collimator assembly as defined in claim 11, wherein the lever comprises first and second legs disposed in an "L"-shaped configuration, and wherein the arm actuates the lever by applying a force to the first leg.

14. An x-ray beam collimator assembly as defined in claim 13, wherein the second leg of the lever is pivotably connected to the blocking member via a pivot pin.

15. An x-ray beam collimator assembly as defined in claim 14, wherein the second leg includes an elongated hole, and wherein the pin that pivotably connects the lever to the blocking member is slidably disposed within the elongated hole.

16. An x-ray beam collimator assembly as defined in claim 10, wherein the blocking member comprises at least two extended portions, the extended portions obstructing portions of the primary x-ray passing region when the blocking member is in the extended position.

17. An x-ray beam collimator assembly as defined in claim 10, further comprising a resilient member that is disposed in relation to the blocking member such that it provides a force to move the blocking member into the retracted position.

18. An x-ray beam collimator assembly as defined in claim 10, wherein the collimator plate and the blocking member comprise an x-ray attenuating material selected from the group consisting of lead, tungsten, and bismuth.

19. An adjustable collimating device for use in collimating an x-ray signal emitted from the surface of an anode within an x-ray tube, the collimating device comprising:

a base member;

a stationary collimator plate attached to the base member in a manner such that the plate is substantially adjacent to the anode, the collimator plate defining at least one slot through which at least a portion of the x-ray beam passes, the collimator plate comprising an x-ray attenuating material;

a blocking member;

means for selectively moving the blocking member between a retracted position and an extended position, wherein when in the extended position the blocking member at least partially obstructs a portion of the slot and thereby prevents a portion of the x-ray signal from passing through the slot; and a resilient member that is disposed in relation to the blocking member such that it provides a force to move the blocking member into the retracted position or the extended postion.

20. An adjustable collimating device as defined in claim 19, wherein the means for selectively moving comprises:

a retractable arm operably connected to the blocking member via a lever, the lever pivotably connected to the blocking member such that selective movement of the retractable arm actuates the lever and moves the blocking member from the retracted position to the extended position in a substantially linear direction.

21. An adjustable collimator as defined in claim 20, wherein the lever comprises first and second legs disposed in an "L"-shaped configuration, and wherein the arm actuates the lever by applying a force to the first leg.

22. An adjustable collimating device as defined in claim 21, wherein the resilient member comprises:

a spring that is disposed in relation to the blocking member so as to provide a force that moves the blocking member from the extended position to the retracted position.

23. An adjustable collimator as defined in claim 19, wherein the collimator plate and the blocking member are substantially comprised of lead.

24. An x-ray beam collimator assembly comprising:

a base member having an outer periphery that is adapted to be received within a port of an x-ray generating device, the base member including a cavity;

a collimator plate attached to an end of the base member, the collimator plate being substantially comprised o f an x-ray attenuating material and defining a primary x-ray passing region; and a blocking member at least partially disposed in the base member cavity, the blocking member comprising:

a block having at least one extending tab, the at least one tab engaging a surface within the base member cavity to enable the blocking member to slide in a linear direction between a retracted and an extended position; and at least two extended portions comprising an x-ray attenuating material, the extended portions being attached to the block and obstructing portions of the primary x-ray passing region to define a secondary radiation passing region when the blocking member is in the extended position.

25. An x-ray beam collimator assembly as defined in claim 24, further comprising a retractable arm operably connected to the block via a lever, the lever being connected to the block such that movement of the retractable arm actuates the lever and moves the blocking member between the retracted position and the extended position.

26. An x-ray beam collimator assembly as defined in claim 25, further comprising a resilient member that is disposed in relation to the blocking member such that it provides a force to move the blocking member into the retracted position.

27. An x-ray beam collimator assembly as defined in claim 26, wherein the resilient member comprises a spring, and wherein the spring is connected to lever.

28. An x-ray beam collimator assembly as defined in claim 27, further comprising at least one guide rod, the guide rod being operable to effect movement of the blocking member between the retracted position and the extended position.

29. An x-ray beam collimator assembly as defined in claim 28, wherein the block includes two tabs oppositely disposed on the block.

30. An x-ray beam collimator assembly comprising:

a base member having an outer periphery that is adapted to be received within a port of an x-ray generating device;

a collimator plate attached to an end of the base member, the collimator plate being substantially comprised of an x-ray attenuating material and defining a primary x-ray passing region;

first and second pivot arms pivotally attached at one end of each arm to the base member, the first and second pivot arms being interconnected in a scissor-like fashion so as to be selectively movable between a retracted position and an extended position; and a first blocking member attached to the first pivot arm, and a second blocking member attached to the second pivot arm, the first and second blocking members obstructing the primary x-ray passing region so as to define a secondary x-ray passing region when the first and second pivot arms are in the extended position.

31. An x-ray beam collimator assembly as defined in claim 30, further comprising a retractable arm operably connected to at least one of the pivot arms such that movement of the retractable arm pivots the first and second pivot arms between the retracted position and the extended position.

32. An x-ray beam collimator assembly as defined in claim 31, further comprising a resilient member that is disposed in relation to the pivot arms such that it provides a force to move the pivots arms into the retracted position.

33. An x-ray beam collimator assembly as defined in claim 32, wherein the resilient member comprises a spring that operably attaches to at least one of the pivot arms.

34. An x-ray beam collimator assembly as defined in claim 33, wherein the first pivot arm includes an extended pin that interconnects with an elongated slot defined in the second pivot arm.

35. An x-ray beam collimator assembly as defined in claim 34, wherein the first and second pivot arms and the first and second blocking members are disposed in a cavity defined in the base member.

36. An x-ray beam collimator assembly as defined in claim 35, wherein the first blocking member is attached to an end of the first pivot arm that is opposite the end that is pivotally attached to the base member, and wherein the second blocking member is attached to an end of the second pivot arm that is opposite the end that is pivotally attached to the base member.

* * * * *

UNITED STATES PATENT AND TRADEMARK OFFICE

CERTIFICATE OF CORRECTION

PATENT NO. : 6,778,636 B1
DATED : August 17, 2004
INVENTOR(S) : Gregory C. Andrews It is certified that error appears in the above-identified patent and that said Letters Patent is hereby corrected as shown below:

Column 1,
Line 22, before "similar fashion" insert -- a --.

Column 2,
Line 10, before "typically allow" remove "the".
Line 16, before "x-ray" insert -- an --.
Line 38, before "the collimator assembly" remove "of".
Line 46, before "pattern that is" insert -- a --.

Column 7,
Line 6, after "the block 68" change "scats" to -- seats --.

Column 9,
Line 50, after "inward toward" insert -- the --.

Column 10,
Line 20, change "As seen in the figure, then," to -- Then, as seen in FIG. 3B, --.
Line 47, after "extensions 88,89" insert -- , --.
Line 53, after "In sum," remove "then,".

Column 11,
Line 2, after "via four" change "screw" to -- screws --.
Line 4, after "already discussed" insert -- , --.

Column 13,
Line 23, change "appropriate iasing force." to -- appropriate biasing force. --.

UNITED STATES PATENT AND TRADEMARK OFFICE

CERTIFICATE OF CORRECTION

PATENT NO. : 6,778,636 B1
DATED : August 17, 2004
INVENTOR(S) : Gregory C. Andrews It is certified that error appears in the above-identified patent and that said Letters Patent is hereby corrected as shown below:

Column 16,
Line 45, after "substantially comprised" change "o f" to -- of --.

Column 17,
Line 8, after "connected to" insert -- a --.

Column 18,
Line 13, change "pivots arms" to -- pivot arms --.

Signed and Sealed this

Sixteenth Day of May, 2006

JON W. DUDAS
*Director of the United States Patent and Trademark Office*